US006123617A

United States Patent [19]

Johnson

[11] Patent Number: 6,123,617

[45] Date of Patent: Sep. 26, 2000

[54] CLEAN ROOM AIR FILTERING SYSTEM

[75] Inventor: Roy P. Johnson, Yacolt, Wash.

[73] Assignee: SEH-America, Inc., Vancouver, Wash.

[21] Appl. No.: 09/184,285

[22] Filed: Nov. 2, 1998

[51] Int. Cl.[7] ..... F24F 3/16

[52] U.S. Cl. ..... 454/187; 55/385.2; 96/108; 454/228

[58] Field of Search ..... 454/187, 228, 454/236; 55/385.2; 96/108

[56] References Cited

U.S. PATENT DOCUMENTS

| | | | |
|---|---|---|---|
| 4,549,472 | 10/1985 | Endo et al. | 454/187 |
| 5,039,321 | 8/1991 | Satoh et al. | 454/187 X |
| 5,109,916 | 5/1992 | Thompson . | |
| 5,314,516 | 5/1994 | Kashima | 454/187 X |
| 5,626,820 | 5/1997 | Kinkead et al. | 454/187 X |
| 5,752,985 | 5/1998 | Nagafune et al. . | |

FOREIGN PATENT DOCUMENTS

| | | |
|---|---|---|
| 5-346239 | 12/1993 | Japan . |
| 8-88155 | 4/1996 | Japan . |
| 8-89747 | 4/1996 | Japan . |
| 9-153533 | 6/1997 | Japan . |
| 9-155126 | 6/1997 | Japan . |

*Primary Examiner*—Harold Joyce
*Attorney, Agent, or Firm*—Oliff & Berridge, PLC

[57] ABSTRACT

An air filtering system for a clean room has a make-up air handling unit that supplies filtered make-up air to a primary air handling unit. The make-up air that enters the make-up air handling unit is supplied from an outside source (such as the air outside of a building containing the clean room). Recirculation air from the clean room is also supplied to the primary air handling unit. A chemical filter filters both the make-up air and the recirculation air prior to the make-up air and the recirculation air entering the clean room. All recirculation air from the clean room and all make-up air passes through the chemical filter and the primary air handling unit prior to introduction to the clean room.

17 Claims, 5 Drawing Sheets

CLEAN ROOM AIR FILTERING SYSTEM

BACKGROUND OF THE INVENTION

This invention relates to air filtration systems and, in particular, air filtration systems for clean rooms used for manufacturing processes which require an extremely clean environment.

Certain manufacturing processes, including the manufacturer of semiconductor devices, require an extremely clean environment. This environment is commonly referred to as a clean room. Proper filtering of the air in a clean room is critical in the manufacturing of, for example, semiconductor devices because even very small contaminants can cause decreases in yield and device performance.

Clean room contaminants may be generally classified as either particulate or gas-phase. Common particulate contaminants include dust, lint and other debris. Gas-phase (or molecular-level) contaminants are typically tens-of-thousands of times smaller than particulate contaminants. Because it is now known that gas-phase contaminants are especially detrimental to device yields and device performance of today's increasingly small semiconductor devices, more effort is now being directed to reducing the level of gas-phase contaminants in clean rooms.

Various filters are known in the art for removing gas-phase contaminants from air. Examples of such chemical filters are discussed in U.S. Pat. No. 5,626,820. One such example of a chemical filter is a chemical filter of the pleated filter type comprising an air permeable, relatively thick web of non-woven fibrous carrier material of pleated form. The web includes a matrix formed of a large multiplicity of synthetic fibers and is characterized in that activated carbon particles are distributed throughout the web, bound in the interstices of the matrix in a manner preventing loss to the air of particles in quantity substantially detrimental to the performance of any HEPA filter that may be downstream of the chemical filter. The activated carbon particles are of the type selected to remove predetermined gas-phase contaminants from the air source. Various clean room filtering systems have been developed including the use of chemical filters to reduce gas-phase contamination of clean room air. Examples of such air filtering systems are shown in U.S. Pat. Nos. 5,109,916, 5,626,820 and 5,752,985.

FIG. 1 shows a conventional clean room air filtering system in which a clean room 10 is supplied with filtered make-up air 80 by a make-up air handling unit 50 which filters make-up air supply 70 with make-up air filter 60. The clean room 10 is also supplied with filtered recirculation air 90 by recirculation air handling unit 48. Recirculation air handling unit 48 draws pre-filtered recirculation air 130 across recirculation chemical filter 110 to produce chemical-filtered recirculation air 100. The system shown in FIG. 1 chemical-filters only pre-filtered recirculation air 130 and does not chemical-filter filtered make-up air 80 until after filtered make-up air 80 passes through clean room 10. Clean room filters 20 are provided for additional filtration prior to clean room supply air entering the clean room area. The clean room filters 20 can be, for example, ultra low penetration air (ULPA) filters or other comparable particulate air filters. Plenum 30 receives filtered make-up air 80 and filtered recirculation air 90 and is located adjacent the clean room filters 20.

FIG. 2 shows a conventional clean room air filtering system similar to the filtering system shown in FIG. 1 except that the chemical-filtering is performed on make-up air supply 70 by make-up chemical filter 120 instead of on pre-filtered recirculation air 130 by recirculation chemical filter 110. Chemical-filtered make-up air 85 is supplied to clean room 10 by make-up air handling unit 50.

While the use of chemical filters in clean room air filtering systems for the purpose of reducing gas-phase contaminants may be known in the art, certain problems exist with these systems. For example, some systems, such as the system shown in U.S. Pat. No. 5,752,985, pass only a portion of the air entering the clean room through a chemical filter and, therefore, allow air that has not been passed through a chemical filter to enter the clean room. Similarly, U.S. Pat. No. 5,109,916 shows filtering system in which only a portion of the air entering a conditioned space is chemical-filtered. Also, systems such as the system shown in U.S. Pat. No. 5,752,985 and Japanese Patent Publication No. JP-A-8-89747 use multiple chemical filters, each with its own fan unit. This type of system typically requires a large number of chemical filters and fan units, resulting in a high initial cost and high maintenance costs.

Other clean room filtering systems, such as Japanese Patent Publication No. JP-A-8-89747, locate the chemical filters and fan units in the ceiling space above the clean room. Such systems result in high maintenance costs due to the difficulty associated with accessing the ceiling space as compared to accessing a remotely located chemical filter and fan unit.

SUMMARY OF THE INVENTION

The inventor of the present invention recognized these problems and developed an air filtering system that addresses them. An air filtering system of the present invention has a make-up air handling unit that supplies filtered make-up air to a primary air handling unit. The make-up air that enters the make-up air handling unit is supplied from an outside source (such as the air outside of the building containing the clean room). Recirculation air from the clean room is also supplied to the primary air handling unit. A chemical filter filters both the filtered make-up air and the recirculation air prior to the make-up air and the recirculation air entering the clean room. All recirculation air from the clean room and all make-up air passes through the chemical filter and the primary air handling unit prior to introduction to the clean room.

By chemical-filtering all of the clean room supply air, the recirculated air is chemical-filtered every time it is recirculated, resulting in the continued removal of gas-phase contaminants produced by processes performed in the clean room. In addition, the system chemical-filters all make-up air prior to introduction to the clean room. In addition, by locating higher capacity chemical filters and air handling units outside of the ceiling space above the clean room, the invention results in decreased maintenance costs.

BRIEF DESCRIPTION OF THE DRAWINGS

The foregoing and further objects, features and advantages of the present invention will be described in or be apparent from the following description of embodiments with reference to the accompanying drawings, where like numerals are used to represent like elements and wherein.

DETAILED DESCRIPTION OF PREFERRED EMBODIMENTS

Figure 3:
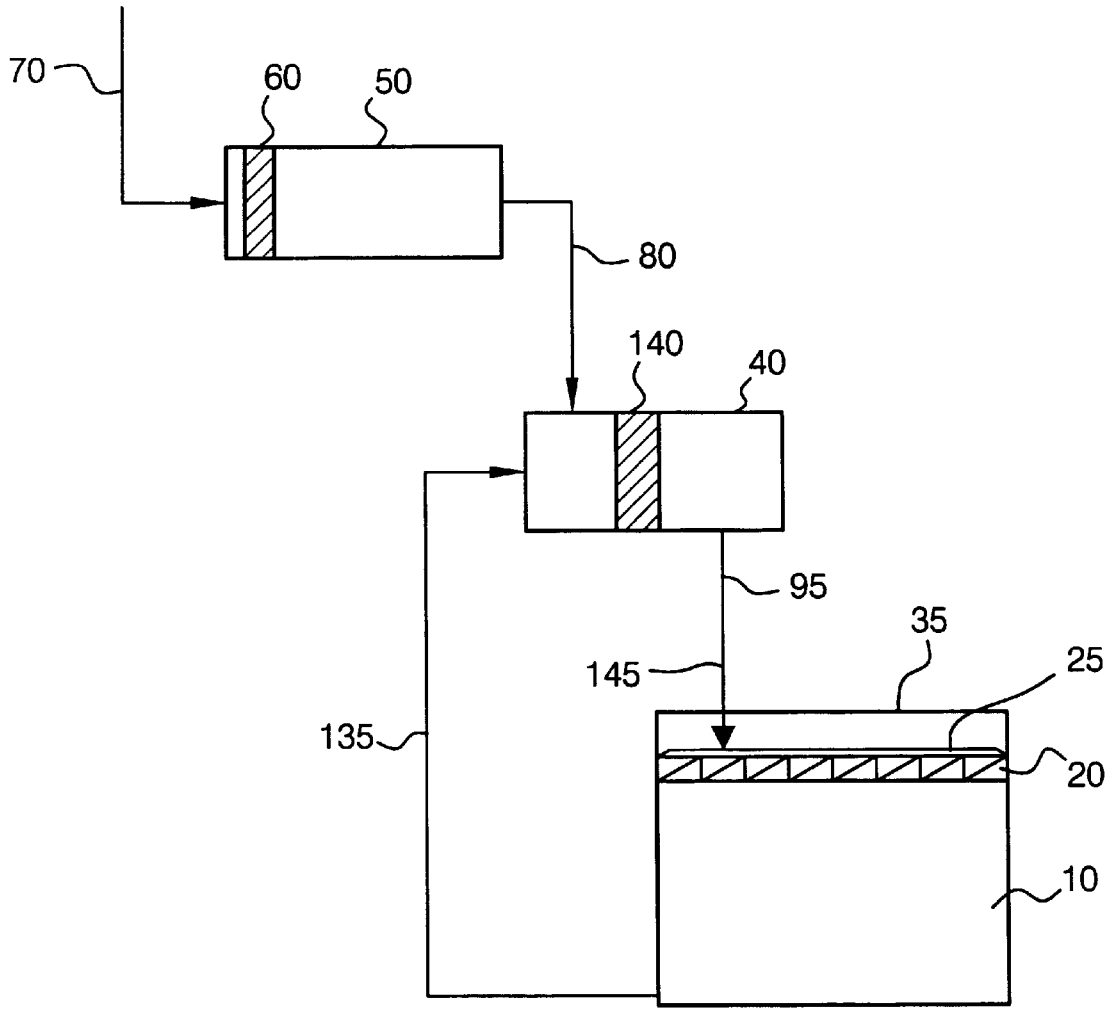
FIG. 3 is a schematic drawing showing an air filtering system of the invention.

FIG. 3 shows a clean room air filtering system of the invention.

In FIG. 3, clean room 10 is supplied with chemical-filtered clean room supply air 95 by primary air handling unit 40. Both filtered make-up air 80 and recirculation air 135 are supplied to primary air handling unit 40. Filtered make-up air 80 is supplied by make-up air handling unit 50, which is, in turn, supplied by make-up air supply 70. Make-up air supply 70 is filtered by make-up air filter 60, which can be, for example, a high-efficiency particulate air (HEPA) filter or other particulate air filter or a series of HEPA and other filters.

Both filtered make-up air 80 and recirculation air 135 pass through at least one supply air chemical filter 140 prior to being supplied to the clean room 10 as chemical filtered clean room supply air 95. The chemical filter can be, for example, one of the types of chemical filters discussed in U.S. Pat. No. 5,626,820. Also, multiple chemical filters may be used. If multiple chemical filters are used, they can be aligned in series with each other.

Figure 1:
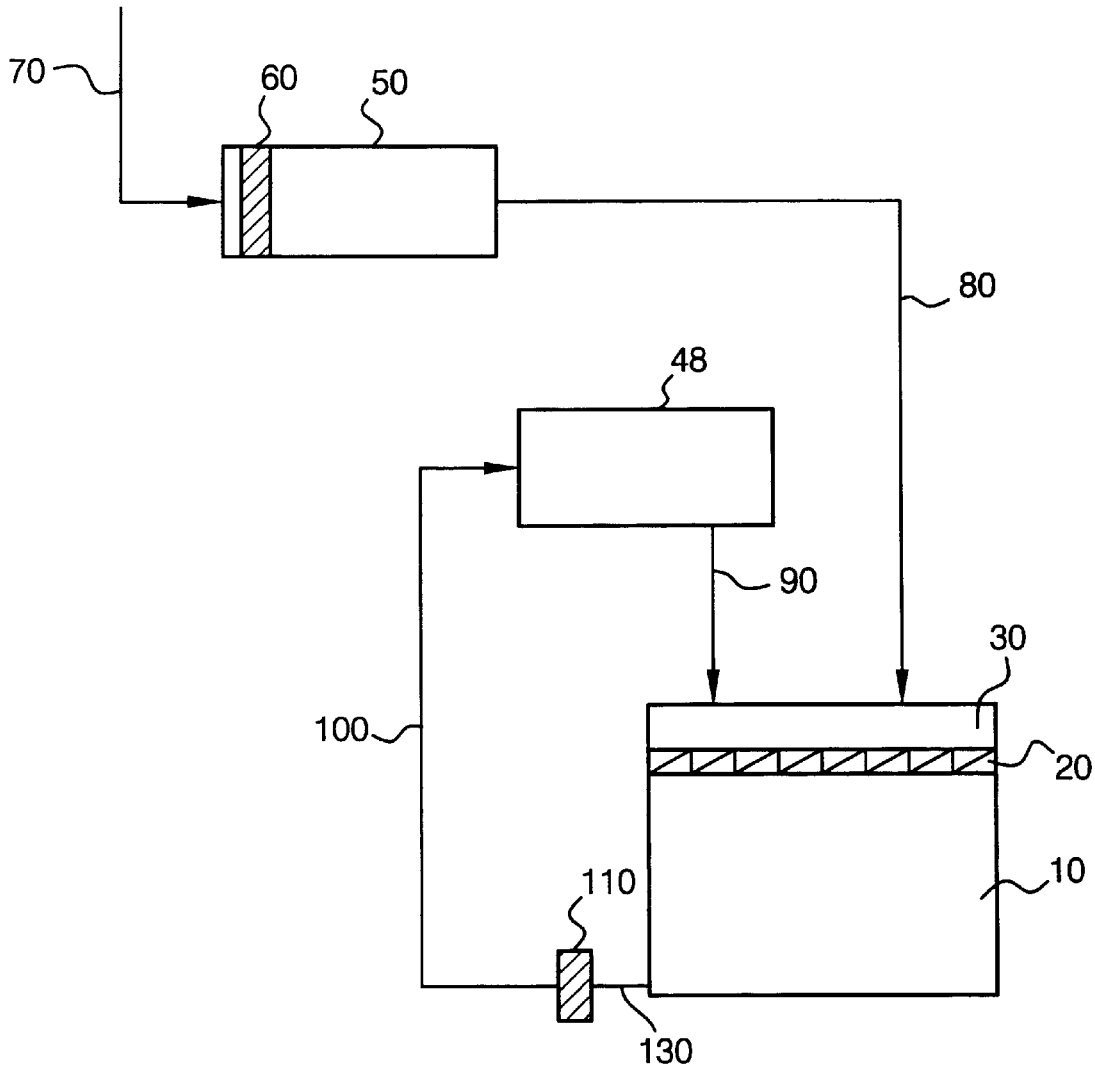
Fig. 1 (Related Art)
FIG. 1 is a schematic drawing of a conventional system using a chemical filter in a recirculation air loop.
Figure 2:
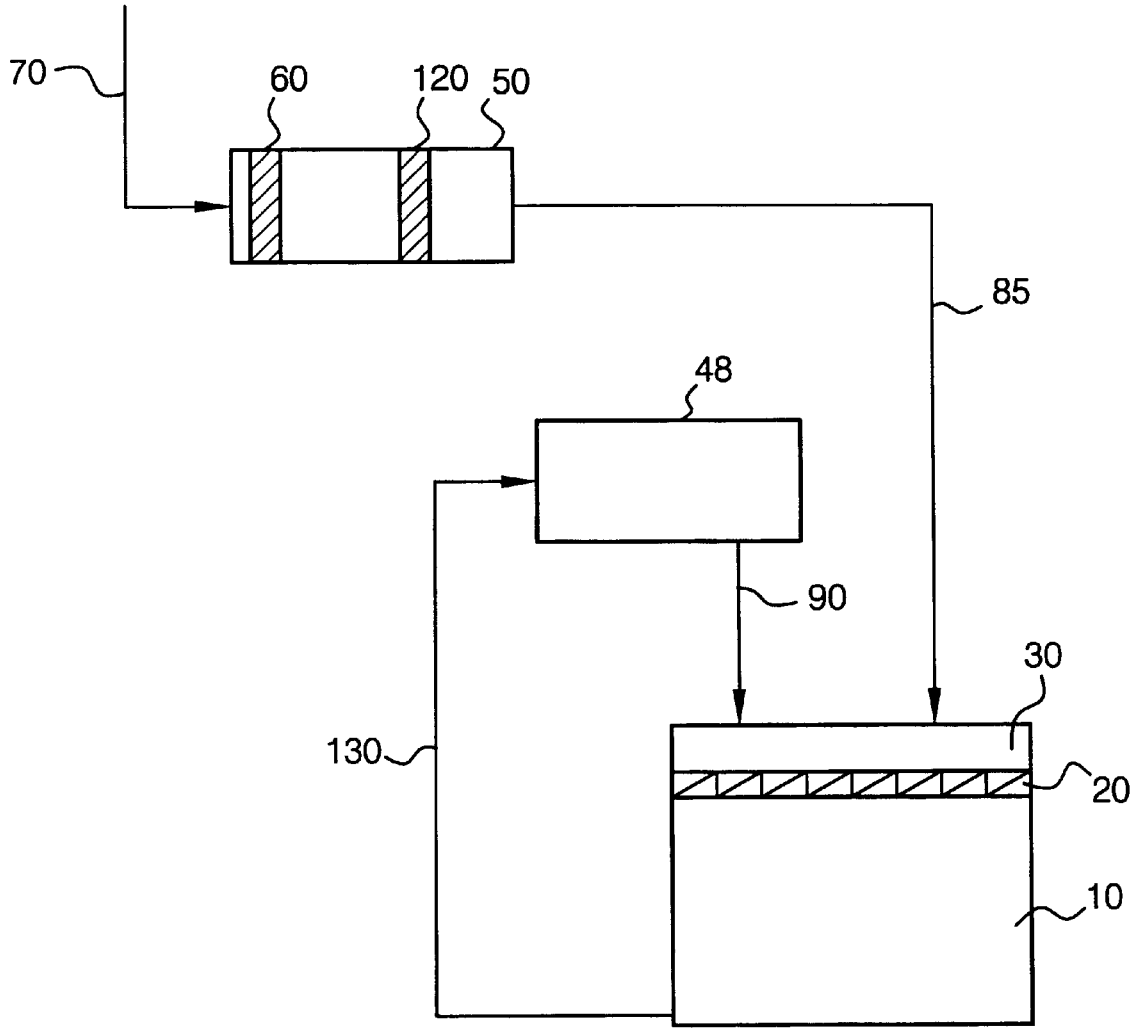
Fig. 2 (Related Art)
FIG. 2 is a schematic drawing of a conventional system using a chemical filter in a make-up air path.

By chemical-filtering all air that is supplied to clean room 10, gas-phase contaminants in both the filtered make-up air 80 and the recirculation air 135 are removed. This approach has the advantage of removing gas-phase contaminants from the make-up air 80 which would otherwise be allowed to enter the clean room 10 (such as in the system of FIG. 1). Also, unlike the system of FIG. 2, the system of FIG. 3 removes gas-phase contaminants from recirculation air 135.

In a preferred embodiment shown in FIG. 3, the chemical-filtered clean room supply air 95 enters a ceiling plenum 25 adjacent the clean room filters 20. The chemical-filtered clean room supply air 95 is supplied to the ceiling plenum 25 from the primary air handling unit 40 through a clean room supply air duct 145. The clean room supply air duct 145 attaches to the ceiling plenum 25 at a location which is within a low pressure ceiling space 35. The air in the clean room supply air duct 145 can be isolated from air in the low pressure space 35. The low pressure ceiling space 35 is maintained at a lower air pressure than the clean room 10. By maintaining the low pressure ceiling space 35 at a lower air pressure than the clean room 10, any leaks that may exist between the clean room 10 and the low pressure ceiling space 35 will result in air transferring from the clean room 10 to the low pressure ceiling space 35 and will, therefore, avoid contaminants entering the clean room 10 from the low pressure ceiling space 35.

By locating the primary air handling unit 40 and the chemical filter 140 outside of the ceiling space 35 of the clean room 10, maintenance of the primary air handling unit 40 and the chemical filter 140 are simplified. Also, locating the primary air handling unit 40 outside of the ceiling space 35 allows the primary air handling unit 40 to be larger, resulting in fewer primary air handling units being required as compared to conventional clean room conditioning systems. This reduction in the number of primary air handlers can further reduce maintenance costs and clean room down time.

All else being equal, the pressure drop across a chemical filter is usually lower than the pressure drop across a particulate filter. By filtering the make-up air supply 70 with the make-up air filter 60 prior to introduction of the filtered make-up air 80 into the primary air handling unit 40, recirculation air 135 does not need to undergo extensive particulate filtering. As approximately 95% of the chemical filtered clean room supply air 95 comes from recirculation air 135 (as opposed to filtered make-up air 80), locating the main particulate filter (make-up air filter 60) outside of the loop driven by primary air handling unit 40 allows the use of a smaller capacity primary air handling unit 40.

Figure 4:
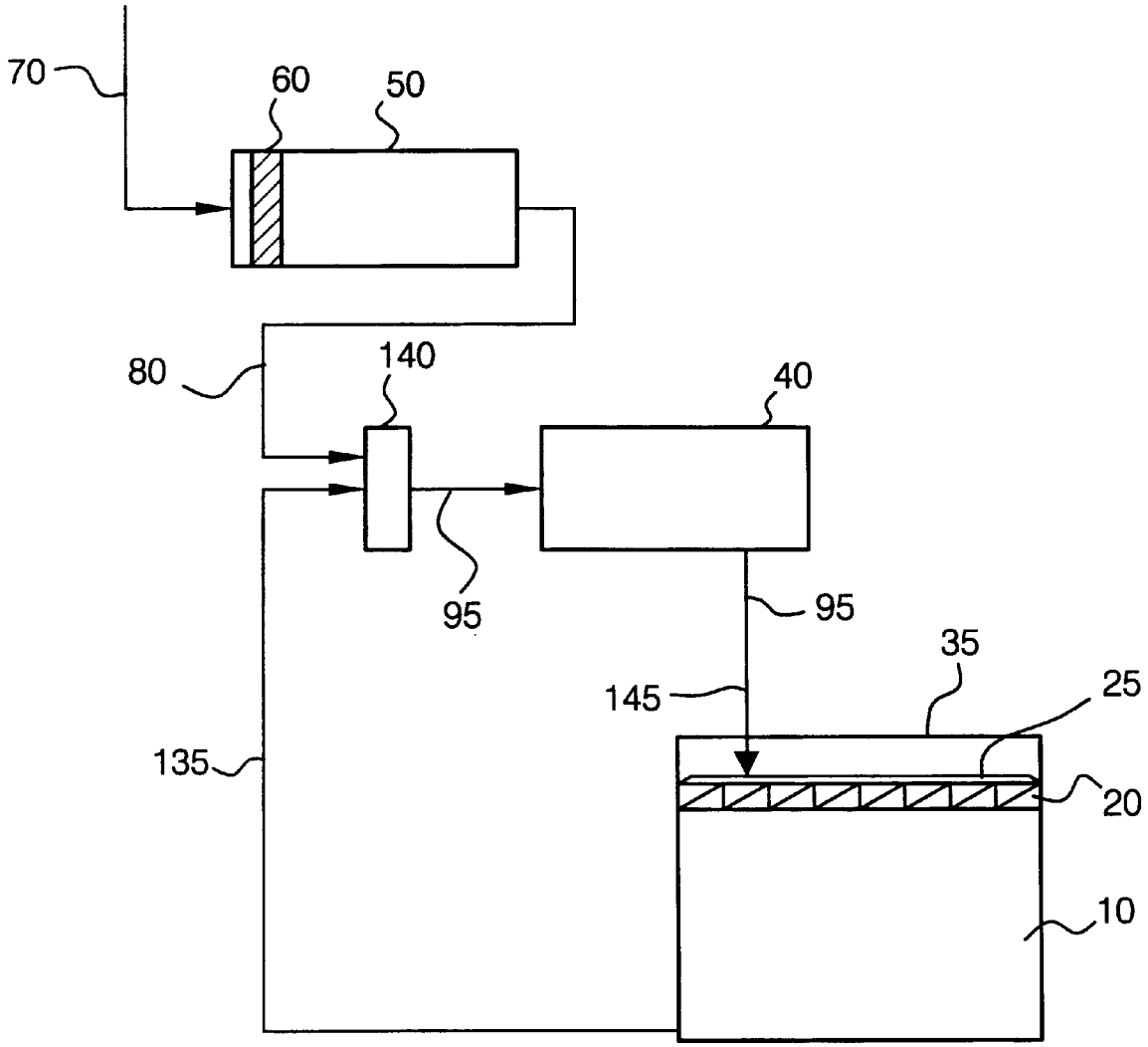
FIG. 4 is a schematic drawing showing an air filtering system of another embodiment of the invention.
Figure 5:
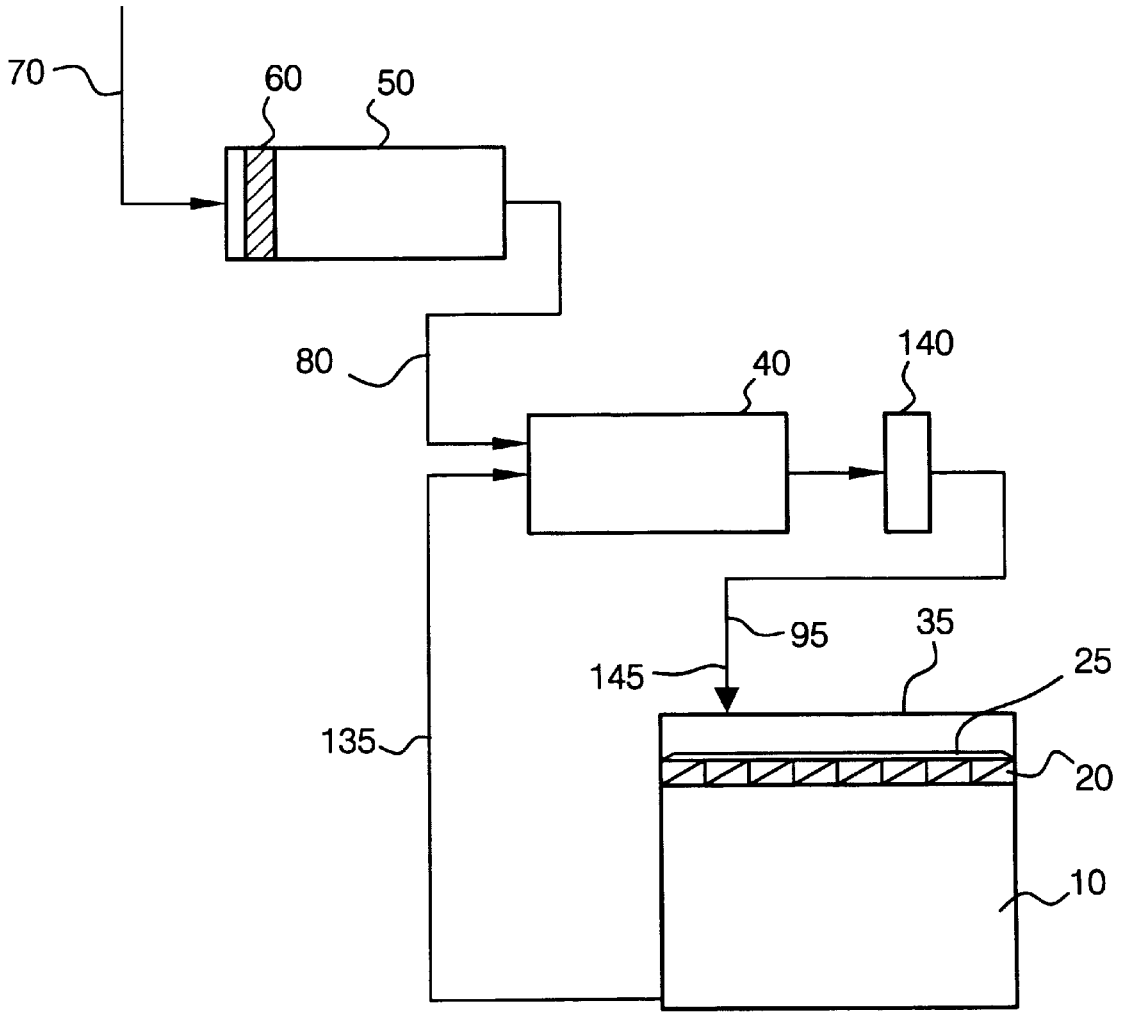
FIG. 5 is a schematic drawing showing an air filtering system of another embodiment of the invention.

Although supply air chemical filter 140 is shown in FIG. 3 as being located within primary air handling unit 40, supply air chemical filter 140 can be located either upstream (FIG. 4) or downstream (FIG. 5) of primary air handling unit 40 as long as filtered make-up air 80 enters the recirculation air loop upstream of supply air chemical filter 140, i.e. both filtered make-up air 80 and recirculation air 135 after being joined pass through supply air chemical filter 140. It is important that filtered make-up air 80 enters the recirculation loop upstream of supply air chemical filter 140 so that gas-phase contaminants can be removed from the filtered make-up air 80 prior to its introduction to clean room 10.

While the present invention has been described with reference to embodiments thereof, it is to be understood that the invention is not limited to the described embodiments or constructions. To the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention.

What is claimed is:

1. An air filtering system for use with a clean room, comprising:

a primary air mover that supplies make-up air and recirculation air to the clean room, the primary air mover being located outside of a ceiling space of the clean room;

a make-up air mover that supplies the make-up air to the primary air mover;

one or a series of make-up air filters that filter the make-up air prior to the make-up air being supplied to the primary air mover;

a recirculation air path that supplies the recirculation air from the clean room to the primary air mover; and at least one chemical filter that filters the make-up air and the recirculation air prior to the make-up air and the recirculation air being supplied to the clean room, wherein all the recirculation air and all the make-up air is filtered by the at least one chemical filter and is supplied to the clean room by the primary air mover.

2. The air filtering system of claim 1, further comprising a conduit for connecting the primary air mover to the clean room.

3. The air filtering system of claim 1, wherein the at least one chemical filter is located upstream of a first location where the make-up air enters the primary air mover and upstream of a second location where the recirculation air enters the primary air mover.

4. The air filtering system of claim 1, wherein the at least one chemical filter is located within the primary air mover.

5. The air filtering system of claim 1, wherein the at least one chemical filter is located between the primary air mover and the clean room.

6. The air filtering system of claim 1, further comprising a clean room filter that filters the air supplied to the clean room by the primary air mover downstream of the at least one chemical filter.

7. The air filtering system of claim 6, further comprising a pressurized plenum between the primary air mover and the clean room filter, the plenum communicating air flow between the primary air mover and the clean room filter.

8. The air filtering system of claim 7, further comprising:

a clean room air supply duct through which the air from the primary air mover passes; and a low pressure space adjacent the plenum and through which the clean room air supply duct passes, the air in the clean room air supply duct being isolated from air in the low pressure space and the air in the low pressure space having a lower air pressure than the air in the clean room.

9. A method of filtering air for use in a clean room, the method comprising:

supplying filtered make-up air from a make-up air mover to a primary air mover;

supplying recirculation air from the clean room to the primary air mover; and filtering the filtered make-up air and the recirculation air with at least one chemical filter prior to supplying the chemical-filtered make-up air and the chemical-filtered recirculation air to the clean room, the chemical filtering being performed at a location outside of a ceiling space of the clean room.

10. The method of claim 9, wherein the chemical-filtered make up air and chemical-filtered recirculation air are supplied to the clean room through a conduit.

11. The method of claim 9, wherein the at least one chemical filter is located upstream of a first location where the filtered make-up air enters the primary air mover and upstream of a second location where the recirculation air enters the primary air mover.

12. The method of claim 9, wherein the at least one chemical filter is located within the primary air mover.

13. The method of claim 9, wherein the at least one chemical filter is located between the primary air mover and the clean room.

14. The method of claim 9, further comprising additionally filtering the air supplied to the clean room by the primary air mover, the additional filtering being performed downstream of the chemical-filtering.

15. The method of claim 14, further comprising communicating air flow between the primary air mover and the additional filtering through a pressurized plenum.

16. The method of claim 9, wherein the step of supplying filtered make-up air comprises supplying particulate filtered air.

17. The method of claim 15, further comprising:

supplying the chemical-filtered make-up air and the chemical-filtered recirculation air to the clean room through a clean room supply duct; and maintaining a low pressure space adjacent the plenum and through which the clean room supply duct passes, the air in the clean room supply duct being isolated from air in the low pressure space and the air in the low pressure space having a lower air pressure than the air in the clean room.

* * * * *